United States Patent [19]

Boyd

[11] 4,126,145

[45] Nov. 21, 1978

[54] LIGHTED COMPACT

[76] Inventor: Raymond Boyd, 2235 Cambridge Rd., Broomall, Pa. 19008

[21] Appl. No.: 776,593

[22] Filed: Mar. 11, 1977

[51] Int. Cl.[2] ..... A45D 33/00; A45D 33/32

[52] U.S. Cl. ..... 132/83 R

[58] Field of Search ..... 132/83 R–83 E, 132/82, 79, DIG. 2; 240/6.45 R

[56] References Cited

U.S. PATENT DOCUMENTS

| | | | |
|---|---|---|---|
| 2,258,540 | 10/1941 | Cressaty | 240/6.45 R |
| 2,258,541 | 10/1941 | Cressaty | 240/6.45 R |
| 2,258,544 | 10/1941 | Cressaty | 240/6.45 |
| 2,438,841 | 3/1948 | Casalino | 132/83 R |

*Primary Examiner*—Louis G. Mancene

*Assistant Examiner*—Gregory E. McNeill

*Attorney, Agent, or Firm*—Duffield & Lehrer

[57] ABSTRACT

A lighted compact has a bottom case member into which are mounted standard sized compact powders. A cover member and an intermediate member both of which have a configuration complementary to the bottom case member are hinged to the bottom case member. Mounted within the inside of the cover member is a battery, a switch and a pair of electric lights. The intermediate member, which covers the battery, lights and switch, includes a mirror and light diffusers. The hinge of the bottom case member includes a cam surface which is adapted to engage the switch of the cover member so that the lights are turned on when the compact is opened and are turned off when the compact is closed.

9 Claims, 7 Drawing Figures

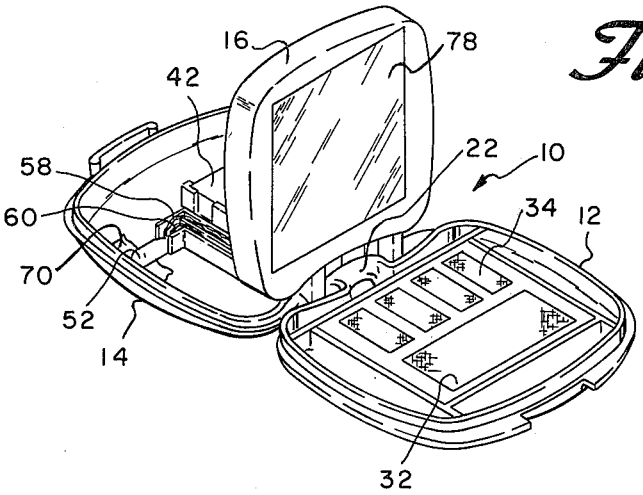
Fig. 1
Fig. 2
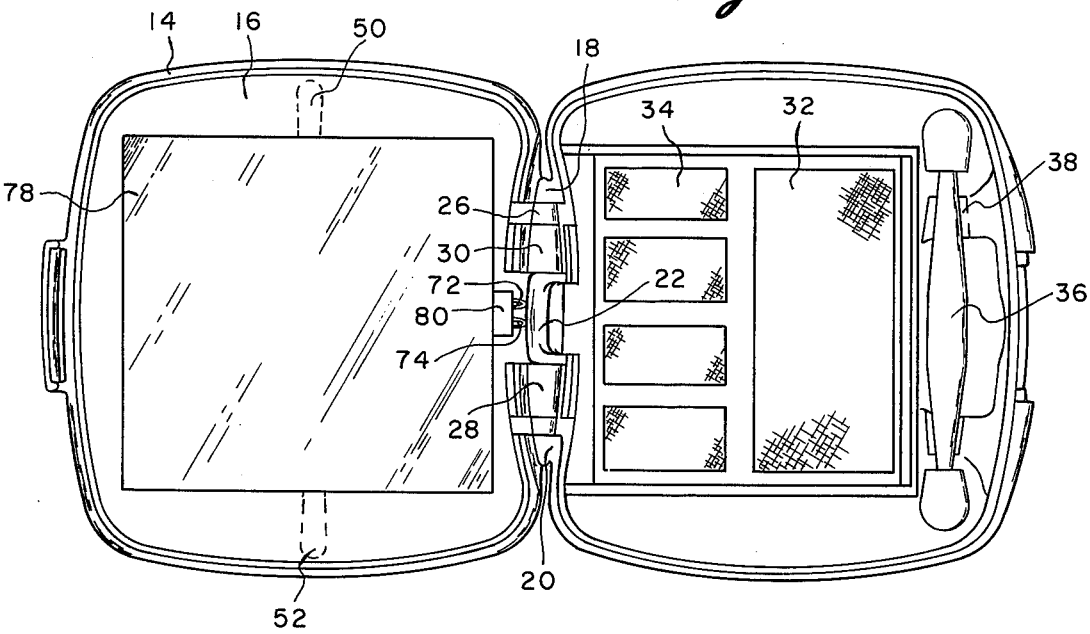
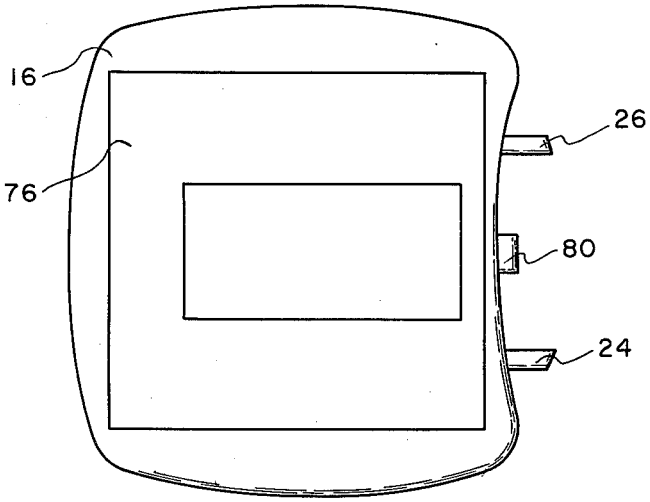
Fig. 3

LIGHTED COMPACT

BACKGROUND OF THE INVENTION

The present invention relates to a lighted compact and more particularly to an illuminated ladies compact which includes a battery source and light bulbs operated by the battery for illuminating the users face.

Battery operated lighted ladies compacts have been known for many years. However, one common fault which exists in these prior art compacts is in the positioning of the various electrical components and in the operation of the switch. In many of these compacts the battery or switch was located in either the cover or bottom member when the lights were mounted in the other. As a result it was often necessary to run wires between the cover and bottom member. Frequent opening and closing of the compact could result in breakage of the wires.

Prior art lighted compacts have also been relatively expensive to manufacture. This resulted from the fact that the electrical components were mounted in several different places making assembly more time consuming. In addition, miniature switches used in prior art devices were relatively expensive and were subject to malfunction after multiple uses. Even further, the various electrical components of the systems had to be connected together, again increasing the manufacturing time and expense.

OBJECTS AND SUMMARY OF THE INVENTION

It is an object of the present invention to provide an illuminated ladies compact which can be easily and inexpensively manufactured.

It is another object of the present invention to provide an illuminated ladies compact which is dependable and not subject to malfunction.

It is a further object of the present invention to provide an illuminated ladies compact wherein the various electrical components can be easily and quickly replaced if repairs are ever necessary.

The foregoing objects are carried out in accordance with the ladies illuminated compact of the present invention by providing a bottom case member into which are mounted standard sized compact powders. A cover member and an intermediate member both of which have a configuration complementary to the bottom case member are hinged to the bottom case member. Mounted within the inside of the cover member is a battery, a switch and a pair of electrical lights. The intermediate member, which covers the battery, lights and switch, includes a mirror and light diffusers. The hinge of the bottom case member includes a cam surface which is adapted to engage the switch so that the lights are turned on when the compact is opened and are turned off when the compact is closed. The electrical conductors of the compact function as the light sockets, the switch and the battery contacts in addition to interconnecting the various components.

Other objects and advantages of the present invention will become apparent to those skilled in the art in the detailed description thereof which follows when taken in conjunction with the drawings.

DESCRIPTION OF THE DRAWINGS

For the purpose of illustrating the present invention, there is shown in the accompanying drawings one form which is presently preferred; it being understood that the invention is not intended to be limited to the precise arrangements and instrumentalities shown.

FIG. 1 is a perspective view of the compact of the present invention in its open position with the intermediate member raised;

FIG. 2 is a top plan view of the compact of the present invention in its fully open position;

FIG. 3 is a plan view of the intermediate members of the compact with the mirror removed;

DETAILED DESCRIPTION OF THE PREFERRED EMBODIMENT

Figure 4:
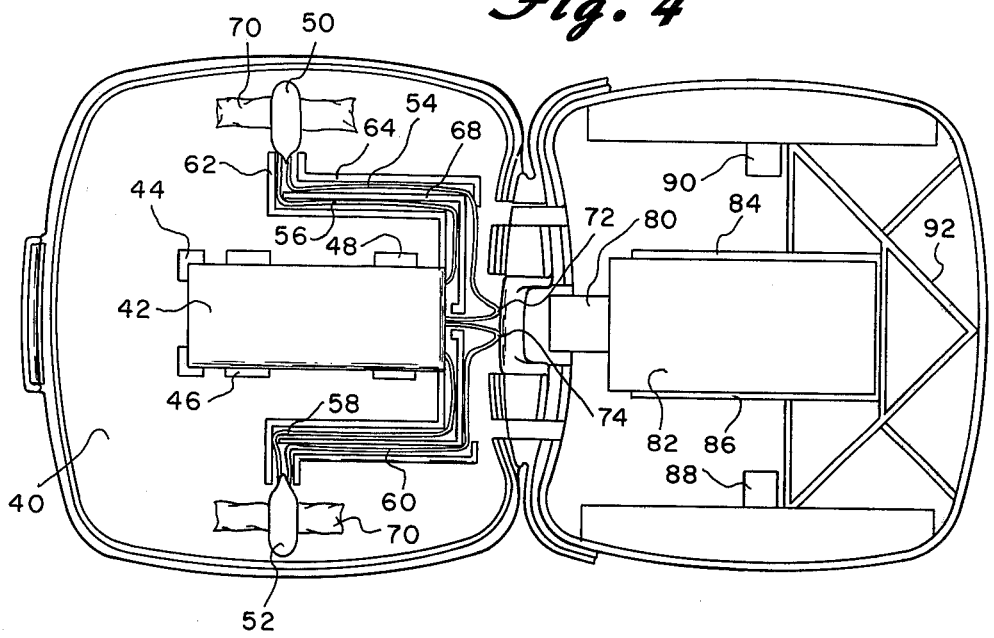
FIG. 4 is a view similar to FIG. 2 but showing the inside of the cover member and the rear side of the intermediate member.

Referring now to the drawings in detail wherein like numerals are used to designate similar elements throughout the various views, there is shown in FIG. 1 a lighted compact constructed in accordance with the principles of the present invention and designated generally at 10. Lighted compact 10 includes three main elements: a shallow bottom case member 12; a shallow cover member 14; and an intermediate member 16.

All three of the members 12, 14 and 16 have a similar peripheral shape. The peripheral configuration of the cover member 14 is complementary to the configuration of the bottom case member 12 as is well known in the art so as to allow the two members to close together. The peripheral configuration of the intermediate member 16 is complementary to but slightly smaller than the inside perimeter of the cover member 14 so that the intermediate member can fit within the cover member 14 as shown in FIG. 2. All three members are hinged for pivotal movement with respect to each other through hinge elements on each of the members. Bottom case member 12 includes hinge elements 18, 20 and 22; intermediate member 16 includes hinge elements 24 and 26; and cover member 14 includes hinge elements 28 and 30. All of the hinge elements are aligned along a single axis 31 (See FIGS. 5 and 6) so as to make all three members 12, 14 and 16 pivotally movable with respect to each other as shown in FIG. 1.

As shown in FIGS. 1 and 2, the bottom case member 12 includes therein a plurality of compacted powders such as 32 and 34. These powders may be eye shadow, blusher, face powder or the like. Also included in the lower case member 12 is a brush 36 and a holder 38 therefor.

The cover member 14, as shown best in FIG. 4 has mounted on the inside surface 40 thereof a relatively flat battery 42. A plurality of upwardly extending ribs such as 44, 46 and 48 maintain the battery 42 in its proper location. Battery 42 may be, for example, a number 9K62 manufactured by P. R. Mallory Co., Inc. Also mounted within cover member 14 are electric light bulbs 50 and 52. Bulbs 50 and 52 are of the type which have a flat glass base having electrical contacts on the opposite surfaces of the base. Bulbs 50 and 52 are wired to the battery 42 through elongated flat spring-like wires 54, 56, 58 and 60. A plurality of raised guide members such as shown at 62 and 64 form a channel which guides the wires 54 and 56 toward the battery. A divider 68 runs between the members 62 and 64 and between the wires 54 and 56 to help guide the same and prevent the wires from shorting. Similar guide members and divider are associated with lamp 52 and wires 58 and 60.

The ends of guide members 62 and 64 adjacent the bulb 50 also function as the socket for the light. It should be noted that the divider 68 stops short of the ends of the members 62 and 64. The wires 54 and 60, however, continue substantially to the end of the channel. Bulb 50 is merely pushed into the space between the members 62 and 64 so that the wires 54 and 56 contact the sides of the base of the bulb. Again, a similar arrangement on the other side of the cover serves as a socket for bulb 52. Preferably also, a reflective material such as shown at 70 is mounted beneath the bulbs.

Wires 54 and 60 also serve as the switch for turning the bulbs 50 and 52 on and off. As shown best in FIGS. 4–7, wires 54 and 60 are bent outwardly in a direction parallel to the plane of the cover member and are then again bent inwardly to form projecting bulges 72 and 74. The ends of the wires 54 and 60, therefore, can be moved into or out of engagement with the terminal at the end of battery 42 to complete the electrical circuit to the bulbs 50 and 52 by moving bulges 72 and 74 to the left or the right, respectively. The bulges 72 and 74 can thus be considered as the actuating means for the switch. The manner in which the bulges 72 and 74 are moved will be more fully described below.

Referring again to FIGS. 1, 2 and 3, it can be seen that intermediate member 16 includes a recess portion 76 into which is mounted a mirror 78. Preferably, the entire intermediate member 16 is made of a translucent material to allow the bulbs 50 and 52 to shine therethrough. However, it is also possible to construct the intermediate member 16 so that only the sides thereof overlying the bulbs 50 and 52 are translucent. Intermediate member 16 also includes a tab 80 which as shown best in FIG. 2 covers the ends of the wires 54 and 60 so that only the bulges 72 and 74 are exposed.

Mounted on the rear surface of the intermediate member 16 adjacent the center thereof is a sponge-like pad 82 which is surrounded by raised ribs 84 and 86. It should be readily apparent that when intermediate member 16 is pivoted into place within the cover 14, the pad 82 is pressed against the battery 42 to prevent the same from rattling and raised ribs 84 and 86 fit around the rib members 44, 46 and 48 to maintain the intermediate member in its proper position. Similarly, foam pads 88 and 90 fit over the bases of the bulbs 50 and 52 to maintain the same in position. Additional ribs such as shown at 92 are also provided to provide structural stability to the intermediate member 16.

As stated above, the switch of the lighted compact of the present invention is comprised of the ends of the wires 54 and 56 which can be moved into and out of contact with one of the terminals of the battery 42. As also stated above, movement of the ends of the wires is accomplished by moving the bulges 72 and 74 toward the battery in a direction parallel to the plane of the cover member 14. This movement is provided by the relative movement between the cover member 14 and bottom case member 12.

Figure 5:
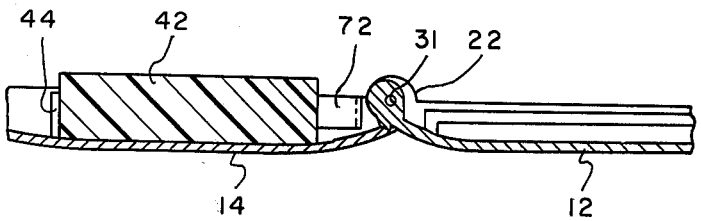
FIG. 5 is a cross-sectional view taken along the line 5—5 in FIG. 4.
Figure 6:
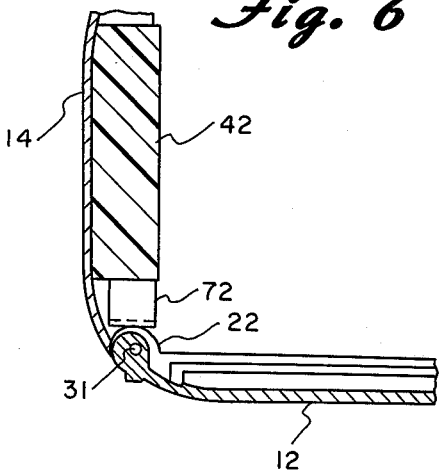
FIG. 6 is a view similar to FIG. 5 but showing the compact in a 90 degree open position.
Figure 7:
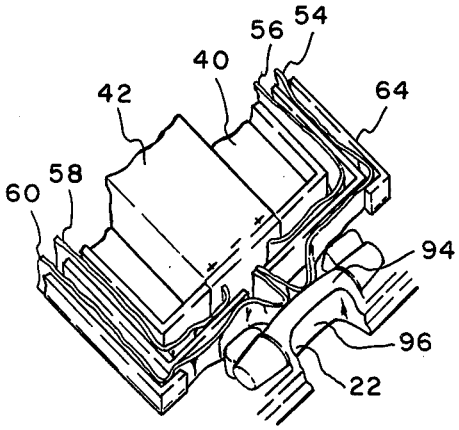
FIG. 7 is a detailed view of the cam and switch arrangement of the present invention.

As shown best in FIG. 7, hinge element 22 carried by the bottom case member 12 includes a rounded portion 94 and a relatively flat cut away portion 96. Hinge element 22 thus functions as a cam surface and provides a control means for turning the bulbs on and off. When the cover member 14 is closed, the bulges 72 and 74 are adjacent the cut away portion 96 of the hinge element 22 and no electrical contact is made with the battery 42. However, when the cover member 14 is opened, the bulges 72 and 74 are forced to move onto the rounded portion 94 of the hinge element 22. This forces the bulges to the left as viewed in FIGS. 4–7 until the ends of the wires 54 and 60 contact the terminal of the battery 42 thereby turning on the bulbs 50 and 52. The bulbs are turned off by merely again closing cover member 14 bringing bulges 70 and 72 back into alignment with the cut away portion 96 of the hinge element 22. In addition, as shown in FIG. 5, the cammed surface of the hinge element 22 is designed so that the ends of the wires 54 and 60 are out of engagement with the terminal of the battery 42, thereby turning off the bulbs 50 and 52, when the compact is in its fully opened position. It should be readily apparent that the surface of the hinge element 22 could be contoured to turn the bulbs 50 and 52 on or off at any desired open position of the compact. Wires 54 and 60 are, of course, made of a spring-like material so that they will return to their normal position wherein the ends are out of engagement with the terminal of battery 42 when the cover member 14 is closed or when it is fully opened.

It should be readily apparent from the above description of the present invention that manufacture and repair of the lighted compact of the present invention are relatively simple and inexpensive. The main components, i.e. the bottom case member 12, cover member 14 and intermediate member 16 include their respective hinge elements and all raised portions such as the ribs 44, guide members 62 and ribs 84 and 92 can be molded in a single compression molding operation. The electrical components are merely fitted into their respective positions and all necessary electrical contacts are automatically made. Repairs to the electrical components are easily made merely by removing the defective component and replacing it with a similar one. Again, the necessary electrical contacts are automatically made by placing the various components in their proper position.

The present invention may be embodied in other specific forms without departing from the spirit or essential attributes thereof and, accordingly, reference should be made to the appended claims, rather than to the foregoing specification as indicating the scope of the invention.

I claim:

1. A lighted compact providing a thin profile comprising:

a shallow bottom case member;

a shallow cover member having a configuration complementary to the peripheral configuration of said bottom case member;

hinge means joining said bottom case member and said cover member for pivotal movement between an opened position and a closed position, part of said hinge means being carried by said bottom case member and part of said hinge means being carried by said cover member;

a mirror positioned within said cover member;

a battery positioned within said cover member behind said mirror;

light diffusing means positioned within said cover member adjacent said mirror;

electrically operated illuminating means positioned behind said light diffusing means;

switch means positioned within said cover member and including movable actuator means;

circuit means electrically interconnecting said battery, said illuminating means and said switch means;

said part of said hinge means on said bottom case member being constituted, at least in part, by a cam surface including a control member adapted to engage said actuator means for alternately moving the same between an off position when said compact is closed to and an on position when said compact is opened.

2. A lighted compact as claimed in claim 1 wherein said actuator means is movable in a plane substantially parallel to the plane of said cover member.

3. A lighted compact as claimed in claim 1 including an intermediate member having a configuration complementary to but smaller than said cover member, said intermediate member carrying said mirror and said light diffusing means and being adapted to fit within said cover member over said battery and said circuit means.

4. A lighted compact as claimed in claim 1 wherein said circuit means includes substantially flat metal strips and wherein channel means are provided within said cover member for maintaining said flat metal strips in their proper position.

5. A lighted compact as claimed in claim 3 wherein said intermediate member is connected to said hinge means so as to be movable with respect to each of said bottom case member and said cover member.

6. A lighted compact as claimed in claim 4 wherein said switch means and actuator means includes part of said flat metal strips.

7. A lighted compact as claimed in claim 6 wherein part of said flat metal strips function as socket means for said illuminating means.

8. A lighted compact as claimed in claim 6 wherein said battery has a terminal at one end thereof and wherein said switch means is comprised of part of said flat metal strips being movable by said cam surface toward said terminal to make an electrical contact directly therewith.

9. A lighted compact as claimed in claim 7 wherein said socket means is comprised of a pair of flat metal strips spaced apart and wherein said illuminating means includes a substantially flat base having an electrial terminal on opposite surfaces thereof, said base being positioned between said spaced apart flat metal strips.

* * * * *

UNITED STATES PATENT OFFICE

CERTIFICATE OF CORRECTION

Patent No. 4,126,145 Dated November 21, 1978

Inventor(s) Raymond Boyd

It is certified that error appears in the above-identified patent and that said Letters Patent are hereby corrected as shown below:

Column 5, line 8 delete "including a control member".

Column 5, line 11 delete "to".

Signed and Sealed this

*Twenty-second* Day of *May 1979*

[SEAL]

*Attest:*

RUTH C. MASON
*Attesting Officer*

DONALD W. BANNER
*Commissioner of Patents and Trademarks*